United States Patent [19]

Hilsman, III

[11] Patent Number: 4,940,093

[45] Date of Patent: Jul. 10, 1990

[54] GRAVEL PACKING TOOL

[75] Inventor: Y. Gilbert Hilsman, III, Tulsa, Okla.

[73] Assignee: Dowell Schlumberger Incorporated, Tulsa, Okla.

[21] Appl. No.: 241,170

[22] Filed: Sep. 6, 1988

[51] Int. Cl.[5] ..... E21B 34/10

[52] U.S. Cl. ..... 166/332; 166/182; 166/319

[58] Field of Search ..... 166/51, 123, 181, 182, 166/194, 321, 323, 332, 387, 319

[56] References Cited

U.S. PATENT DOCUMENTS

| | | | |
|---|---|---|---|
| 3,726,343 | 4/1973 | Davis, Jr. | 166/51 |
| 4,635,716 | 1/1987 | Zunkel | 166/51 |
| 4,657,082 | 4/1987 | Ringgenberg | 166/321 |
| 4,660,637 | 4/1987 | McGill et al. | 166/120 |
| 4,726,419 | 2/1988 | Zunkel | 166/51 |
| 4,749,044 | 6/1988 | Skipper et al. | 166/323 |

*Primary Examiner*—Jerome W. Massie
*Assistant Examiner*—Terry Lee Melius
*Attorney, Agent, or Firm*—Stephen A. Littlefield

[57] ABSTRACT

An apparatus for closing a reverse circulation passage and opening a crossover fluid passage in a gravel packing service tool which sets a well packer comprises a closure means for closing the reverse circulation passage and an opening means for opening the crossover fluid passage in response to an axial lifting force on the service tool. The closure means is preferably an automatic closure valve having a sleeve with a substantially cylindrical bore and a radially disposed upper surface; and a substantially cylindrical rod and piston assembly moveable within the bore, the assembly including a partial axial fluid flow passage and a connecting radially disposed fluid port whereby fluid flowing within the fluid flow passage flows outwardly of the piston through the port when the port is in an open position axially away from the radially disposed outer surface and resilient damper means restraining movement of the piston within said bore and maintaining the port in the open position under relatively low fluid pressure conditions.

4 Claims, 3 Drawing Sheets

GRAVEL PACKING TOOL

This invention relates to the art of gravel packing of subterranean boreholes and, more particularly to an apparatus and method for opening and closing crossover ports in a gravel packer service tool.

BACKGROUND OF THE INVENTION

An oil well borehole which is being prepared for oil and/or gas production generally includes a steel casing supported by a cement casing in the annulus between the outside wall of the steel casing and the walls of the borehole. The cement casing isolates two or more zones such as, for example, a production zone from an aqueous brine zone. Typically, a number of perforations are formed in the casing and through the cement in the production zone thereby providing fluid communication between the formation and the well. A production well string provides a fluid conduit through which the produced oil or gas travels to the surface. A portion of the production string opposite the casing perforations is referred to as the screen. The screen is made of tubing with numerous holes or slots formed in the tubing wall. Wire is then typically wrapped around the tubing so as to achieve a desired mesh which permits the formation products to flow up the production string but blocks the passage of undesirable solid materials entrained in the oil or gas.

One of the more serious problems encountered in producing well fluids is the presence of formation solids, particularly sand, in the produced fluid. Because of the high fluid pressures involved, there is a sand blasting effect on the screen which can quickly lead to premature erosion and failure of the screen and tubing.

A common technique used to overcome the effect of erosion by formation sand is to pack gravel in the casing perforations and in the annulus around the screen within the casing. The gravel acts as a filter which blocks the passage of formation sand to the screen but which permits the products such as oil and gas to permeate to the screen and flow up the production string.

The so-called gravel pack comprises gravel mixed with water and other materials such as thickening agents, suspension agents and the like and is pumped as a slurry down the well and into the formation at the perforations. The gravel must be effectively packed in order to prevent voids which would limit its effectiveness as a filter medium. When packed under pressure, the slurry dehydrates with the carrier fluid being returned to the surface through a wash pipe.

The gravel packing process is carried out using a packer apparatus and a service tool. Generally, the packer is an apparatus which, in normal use, is placed in the well and directs the slurry to flow to the desired location for gravel packing. The packer performs this task by separating the annulus between the production string and the casing in two sealed regions, i.e., the upper annulus above the packer and the lower annulus which is below the packer. The packer is provided with a plurality of slips which can be hydraulically actuated to bite into the casing to locate and support or set the packer against the casing in the annulus. A plurality of packer sealing elements are then compressed and/or expanded radially outwardly against the casing to effect the seal between the upper and lower annuli.

The hydraulic actuation of the packer and its sealing elements is effected by the use of a service tool which may also be referred to as a running tool or a crossover tool. The service tool is connected to the packer, typically by threaded engagement, and both tools are run simultaneously into the well with a work string. The service tool provides a conduit in conjunction with the work string tubing for hydraulically setting the packer and, additionally, provides crossover ports for carrying the gravel slurry from the tubing outwardly into the lower annulus through openings or squeeze ports in the tool. In normal use, the service tool is removed from the well after the packing operation is completed and the packer remains set in the well. After the service tool is removed, the production string can be run into the well and formation fluids can be withdrawn through the production string to the surface.

The manner in which the service tool has been connected to and released from the packer is generally accomplished in one of two ways. In one type of packer/service tool connection, the service tool is in threaded engagement with corresponding threads on the packer prior to insertion into the wellbore. After the use of this type of service tool has been completed, it is released from the packer by applying torque to the service tool in order to release the threaded engagement with the packer. In another type of packer/service tool release mechanism such as described in U.S. Pat. No. 4,660,637, a fluid passage in the service tool is blocked such as by a ball which is conveyed to the service tool through the tubing and which seats in a ball seat provided in the service tool. A high pressure is then applied against the ball and ball seat to a point at which shear pins coupling the service tool with the packer are sheared thereby releasing the service tool for retrieval.

A ball seat and tubing-conveyed ball are also used in such packer/service tool arrangements to close off reverse circulation of well fluids (up the tubing); for allowing hydraulic pressure setting of the packer; to effect the opening of the gravel packing crossover ports so that fluid communication between the service tool tubing and the lower annulus to be gravel packed is made and, finally, to release the service tool from the packer for retrieval. In all cases, such ball sealing is effected by inserting the ball at the surface and allowing it to gravitate pumping it through the tubing to the ball seat.

After seating of the ball, all of the various operations of setting the packer, opening the crossover ports and release from the packer are effected by stepped increases in the fluid pressure against the seated ball. Obviously, precise control of the pressure and pressure increases and avoidance of high pressure pulses is critical to the proper operation of the packer/service tool assembly.

Additional problems with the above arrangement can arise due to improper seating or "loss" of the tubing-conveyed sealing ball. The passage of the ball through the tubing can be arrested such as by hanging up in a deviated hole at a tubing bend. As hole deviations approach horizontal, the problems with tubing-conveyed sealing balls increases to the point of near total unreliability that the ball will reach and proper seat so that the various pressure-activated procedures may be performed. An additional problem with a tubing-conveyed sealing ball involves the time it takes for passage through the tubing to the seat which can take as long as several hours in a deep and/or deviated well.

SUMMARY OF THE INVENTION

In one aspect, the present invention reduces or eliminates the need for multiple pressurizing steps for shutting off reverse circulation, setting the packer, opening the crossover ports and releasing the service tool from the packer. In another aspect of the invention, the use of a somewhat unreliable ball and ball seat closure mechanism is eliminated.

In accordance with the invention, an apparatus for closing off reverse circulation and opening a crossover fluid passage in a gravel packing service tool which is used to set a well packer comprises closure means for closing the crossover fluid passage and opening means for opening the fluid passage in response to an axial lifting force on the service tool.

Further in accordance with the invention, the above-mentioned opening means for opening the fluid passage in response to an axial lifting force comprises a sliding sleeve having a shoulder which engages a corresponding shoulder on the packer which mechanically opens the crossover ports in response to the axial lifting force on the service tool.

Still further in accordance with the invention, the means for closing the reverse circulation ports includes an automatic closure valve including a sleeve having a substantially cylindrical bore and a radially disposed outer surface and a substantially cylindrical piston movable within the cylindrical bore, the piston including a partial axial flow passage and a connecting, radially disposed fluid port whereby fluid flowing within the fluid flow passage flows outwardly of the piston through the port when the port is in an open position axially away from the radially disposed outer surface and further including resilient damper means restraining movement of the piston within the bore and maintaining the port in the open position under relatively low fluid pressure conditions caused by flow.

It is therefore an object of this invention to provide a means for avoiding a multi-step pressurization to effect various closing, setting, opening and releasing operations of a gravel pack service tool and packer.

It is a further object of this invention to provide a gravel pack service tool and packer which avoids the use of a ball and ball seat and multiple pressurization steps in the use of the packer.

It is yet another object of this invention to provide an automatic closure valve which can be used in place of a ball and ball seat sealing arrangement in a gravel pack packer and service tool assembly.

BRIEF DESCRIPTION OF THE DRAWINGS

These and other objects of the invention will become apparent to those skilled in the art upon a reading of the following detailed description of the invention taken in conjunction with the accompanying drawings forming a part of this specification and in which.

DETAILED DESCRIPTION OF THE PREFERRED EMBODIMENTS AND THE DRAWINGS

Figure 1:
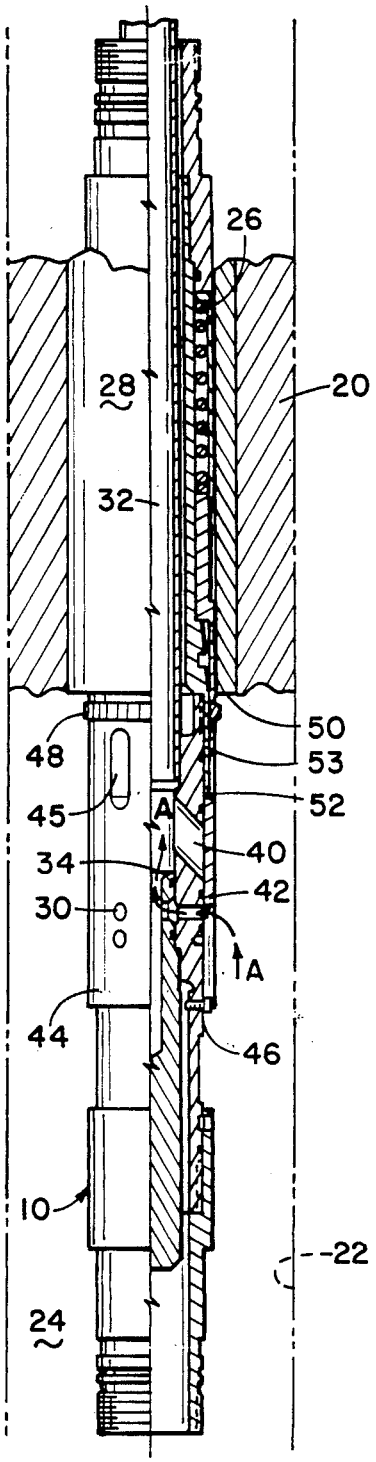
FIG. 1 illustrates a portion of gravel pack service tool in accordance with the present invention following run-in into the well.

Referring now to the drawings wherein the showings are for the purposes of illustrating the preferred embodiments of the invention to those skilled in the art and not for the purpose of limiting the scope of the invention, FIG. 1 shows a portion of a gravel pack service tool 10 disposed within a packer 20 (in phantom) which extends to the inner walls 22 of a well casing (shown in phantom). It will be understood that while in the inner walls 22 are described hereinafter as being the walls of a well casing, it is also possible with a so-called open hole completion that the walls 22 would be merely the earthen walls of a borehole. The packer 20 isolates a lower annulus 24 of the wellbore within the casing inner walls 22.

The service tool 10 is connected to the packer 20 through a threaded connection 26 as described in U.S. Pat. No. 4,660,637, acting on a central packer sleeve 28. FIG. 1 illustrates the gravel pack service tool as it is run into the well prior to the setting of the packer 20 in sealing engagement against the inner walls of the casing 22. In this mode, well fluid in the lower annulus 24 can pass in the direction of arrows A in a reverse circulation mode through the reverse circulation ports 30 and the inner bore 32 of the service tool 10. In order to close off the reverse circulation A and to set the packer, a tubing-conveyed sealing ball (not shown in FIG. 1) is inserted into the inner bore of the service tool at the surface and is pumped through the service tool 10 to seating engagement in a ball seat 34 in the service tool 10. Fluid pressure within the inner bore 32 causes the ball to seal off of the well fluids through the reverse circulation port 30. With reverse circulation being sealed off, the inner bore 32 can be further pressurized to effect the pressure activated setting of the packer 20 against the inner walls 22 of the well casing.

Once the packer 20 has been set, it is desired to open the gravel pack fluid conduit 40 into fluid communication with the lower annulus 24. In accordance with the invention and as shown in FIG. 1, the gravel pack fluid conduits 40 are initially closed off by a wall 42 of a sliding sleeve 44 surrounding the outer surface of the service tool 10. The sliding sleeve 44 is held in position closing off the gravel pack fluid conduit 40 by one or more shear pins 46 connected to the body of the service tool 10.

In accordance with the invention, a radially outwardly extending circumferential snap ring 48 is located on the service tool 10 between the sliding sleeve 44 and a radially extending shoulder 50 located on the packer sleeve 28.

Figure 2:
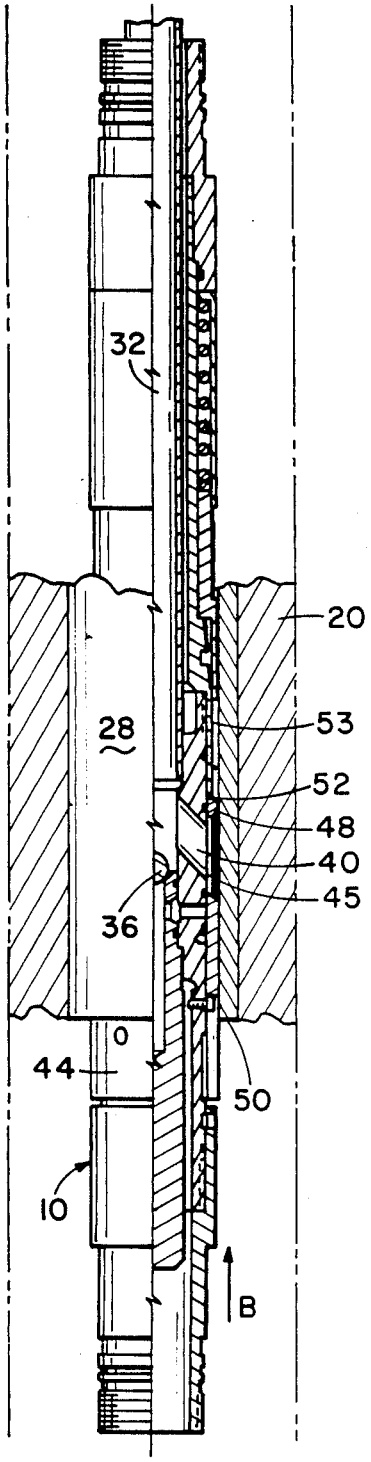
FIG. 2 shows the service tool of FIG. 1 following axial lifting to open the crossover ports and release of engagement with the packer.

In accordance with the invention, the service tool 10 is simultaneously released from the packer 20 and the crossover ports 45 are opened to fluid communication with the gravel pack fluid conduits 40 and the inner bore 32 of the service tool 10 by lifting the service tool on its tubing string axially upwardly in the direction of arrow B (FIG. 2). With this movement in accordance with the method of the invention, the snap ring 48 initially engages the shoulder 50 of the central packer sleeve 28, this action applying a compression force along the sliding sleeve 44 and shearing the shear pins 46 thereby allowing the snap ring 48 and the sliding sleeve 44 to move axially downwardly relative to the service tool 10 thereby exposing the crossover ports 45 into fluid communication with the gravel pack fluid conduit 40. The snap ring 48 is pushed axially downwardly along the service tool 10 until it reaches a downwardly facing radial surface portion 52 of a latch mechanism 53 in the body of the service tool 10, the radial surface 52 forming a recess allowing the snap ring to close radially inwardly thereby reducing the outer diameter of the snap ring to a point where it can freely pass through the bore of the central packer sleeve 28. At this point, the service tool 10 can move freely upwardly and downwardly relatively to the packer 20. The service tool can then be lowered so that the crossover ports 45 are in fluid communication with the lower annuls 24 and normal gravel pack operations can be accomplished by pumping the gravel pack slurry through the inner bore 32 into the lower annulus 24 via the gravel pack fluid conduits 40 and the crossover ports 45. Following completion of the gravel packing operation, the service tool 10 may be withdrawn by merely lifting it through the packer sleeve 28.

The afore-mentioned service tool mechanism overcomes the problems of multiple-stepped pressurization for the processes of closing off reverse circulation, setting the packer, opening the crossover ports and releasing the service tool from the packer. However, such mechanism still requires the use of a tubing-conveyed ball seal with its associated unreliability. In accordance with another aspect of the present invention, the ball and ball seat sealing arrangement is eliminated by the substitution of an automatic closure valve 60 as illustrated in FIGS. 3–7.

The automatic closure valve 60 generally comprises an outer body 62 which includes means for mounting the automatic closure valve 60 in a packer service tool such as by threads 64. The outer body 62 has a longitudinal inner bore 66 which receives a rod and piston assembly 68. An upper portion 69 of the rod and piston assembly 68 extends outwardly of the outer body 62 and includes a central bore 70 and reverse circulation passages 72. In the open position of the valve 60, fluid can flow freely through the reverse circulation passages 72 and the central bore 70 as indicated by the arrows C. The portion of the rod and piston assembly 68 within the inner bore 66 of the outer body 62 also includes a piston 74 which is movable within the inner bore 66 to define a lower piston chamber 76 and an upper piston chamber 78. The upper and lower piston chambers 78, 76 are preferably filled with an hydraulic fluid.

In the operation of the automatic closure valve within the service tool, pressurized fluid within its inner bore acts against the upper portion 69 of the rod and piston assembly and causes fluid to flow outwardly through the reverse circulation passages 72. As pressure within the inner bore of the service tool is increased, the rod and piston assembly 68 is pushed by the pressure differential further into the inner bore 66 of the automatic closure valve 60 thereby progressively closing off portions of the reverse circulation passages 72 until such passages are completely closed off. When the rod and piston assembly 69 has traveled sufficiently into the inner bore 66 to close off the reverse circulation passages 72, a locking pawl 86 is moved radially outwardly by a spring 88 (FIG. 4) to engage on the underside land portion 90 of the outer body 62.

In accordance with a preferred embodiment of this invention, the piston 74 includes a restricted flow passage 80 (FIGS. 3 and 4) for passage of hydraulic fluid from the lower piston chamber 76 into the upper piston chamber 78 in order to dampen the movement of the rod and piston assembly 68 into the automatic closure valve 60. The size of the restricted flow passage 80 may be chosen to selectively control the flow of hydraulic fluid between the lower piston chamber 76 into the upper piston chamber 78 in response to a desired tubing pressure.

Figure 6:
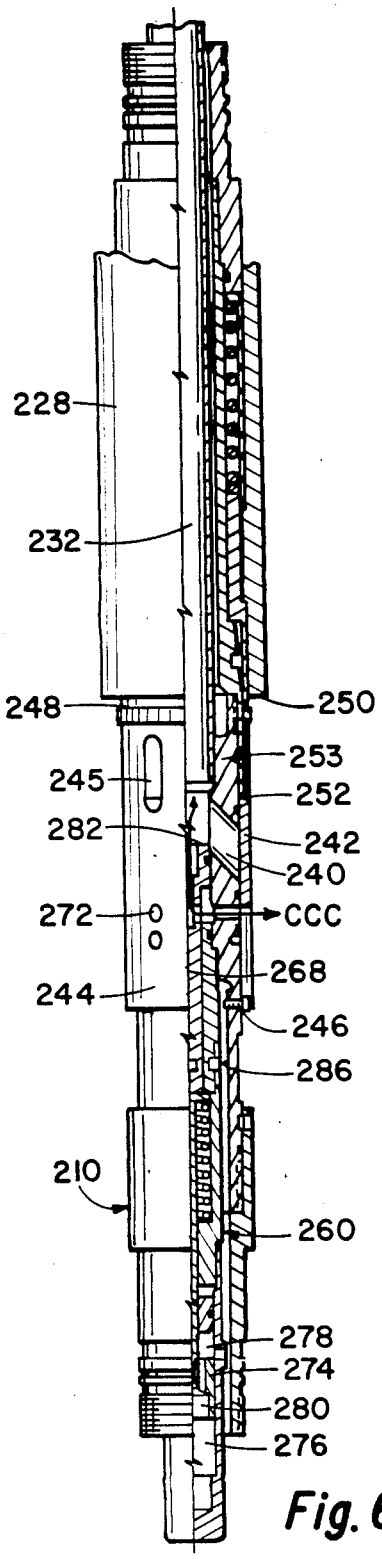
FIG. 6 shows the automatic closure valve of the present invention in conjunction with the gravel pack service tool of the present invention in the reverse circulation mode as run into the well.
Figure 7:
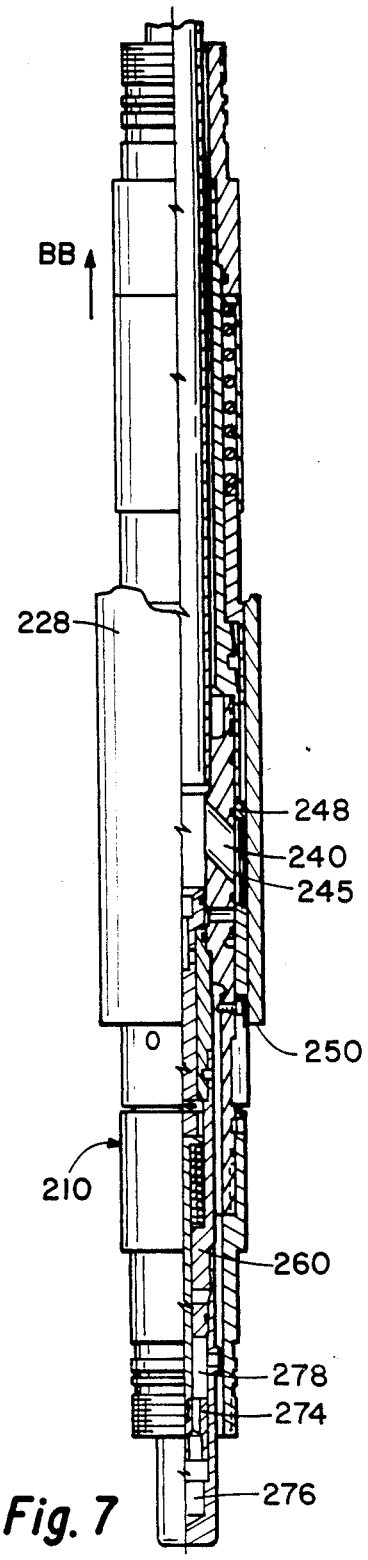
FIG. 7 shows the service tool/automatic closure valve assembly of the present invention with the automatic closure valve in the closed position and the crossover ports in the open position following the application of the lifting force to the service tool.

As can be seen through a review of the FIGS. 6 and 7, the automatic closure valve effects the same operation of closing off reverse circulation so that pressure may be increased to set the packer in a manner similar to that of the mechanism shown in FIGS. 1 and 2 without the use of a ball and ball seat arrangement. However, as a backup in case of failure of the automatic closure valve mechanism, the upper portion 69 of the rod and piston assembly (FIGS. 3 and 4) may also incorporate a ball seat 82. With the use of a tubing-conveyed ball, the mechanism shown in FIGS. 6 and 7 would operate substantially identically to that shown in FIGS. 1 and 2.

Figure 3:
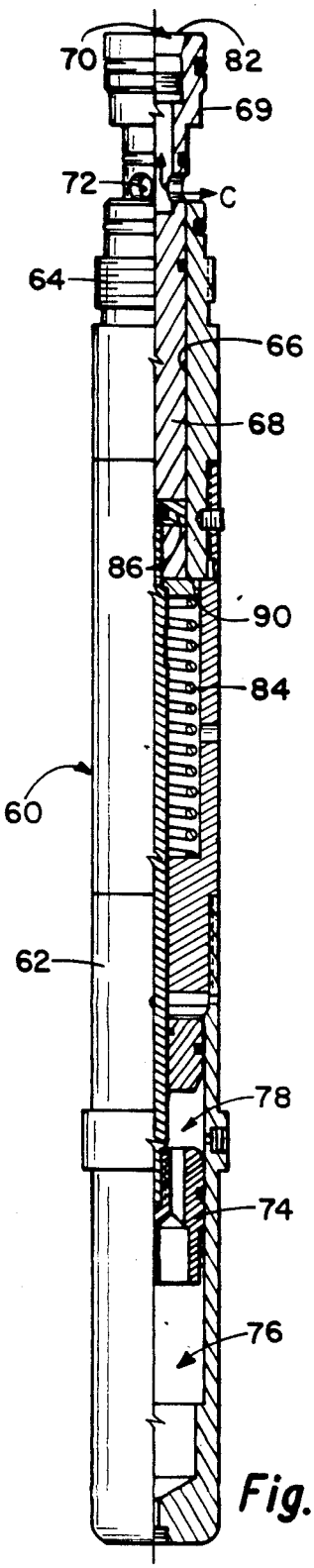
FIG. 3 illustrates one form of an automatic closure valve in the open position in accordance with the present invention.
Figure 4:
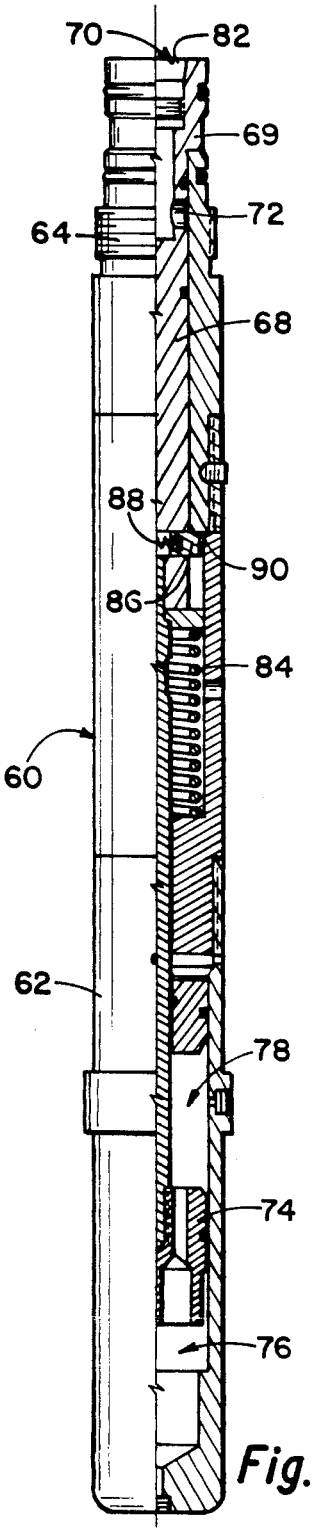
FIG. 4 shows the automatic closure valve of FIG. 3 in the closed position.

As with the mechanism shown in FIGS. 1 and 2, the apparatus in FIGS. 6 and 7 incorporating the automatic closure valve of FIGS. 3 and 4 comprises a gravel pack service tool 210 in conjunction with a packer (not shown) having a central packer sleeve 228. In its initial condition as run-in into the well (FIG. 6), the reverse circulation ports 272 are in fluid communication with the inner bore 232 of the service tool 210. Reverse circulation flow is thereby permitted in the direction of arrows CCC in the manner previously described. In order to close off the reverse circulation ports 272, fluid pressure from the surface is increased through the service tool inner bore 232 which causes the rod and piston assembly 268 of the automatic closure valve 260 to move downwardly into the closed position. Hydraulic fluid in the lower piston chamber 276 flows through the restricted flow passage 280 of the piston 274 to the upper piston chamber 278 in a fluid-damped manner which avoids unintended closure of the valve by a short-term pressure pulse. At the limit of the travel of the rod and piston assembly 268, the locking pawl 286 locks the rod and piston assembly 268 in the closed position thereby closing off the reverse circulation ports 272.

The opening of the crossover ports 245 into fluid communication with the gravel pack fluids 240 is then effected in identical manner as described with respect to FIGS. 1 and 2. The gravel pack service tool 210 is lifted axially in the direction of the arrow BB so that snap ring 248 engages the shoulder 250 of the central packer sleeve 228 forcing the pin 246 to shear thereby allowing the sliding sleeve 44 to move downwardly thereby opening the crossover ports 245. As the snap ring 248 is forced axially downwardly along the service tool 210, ring 248 snaps radially inwardly over the radial surface 252 of the latch mechanism 253 thereby reducing the outer diameter of the ring 248 allowing it to pass freely into the packer sleeve 228. As previously stated, the automatic closure valve 260 includes a ball seating surface 282 for effecting the close-off of reverse circulation (arrows CCC) in the event of failure of the automatic closure valve mechanism.

Figure 5:
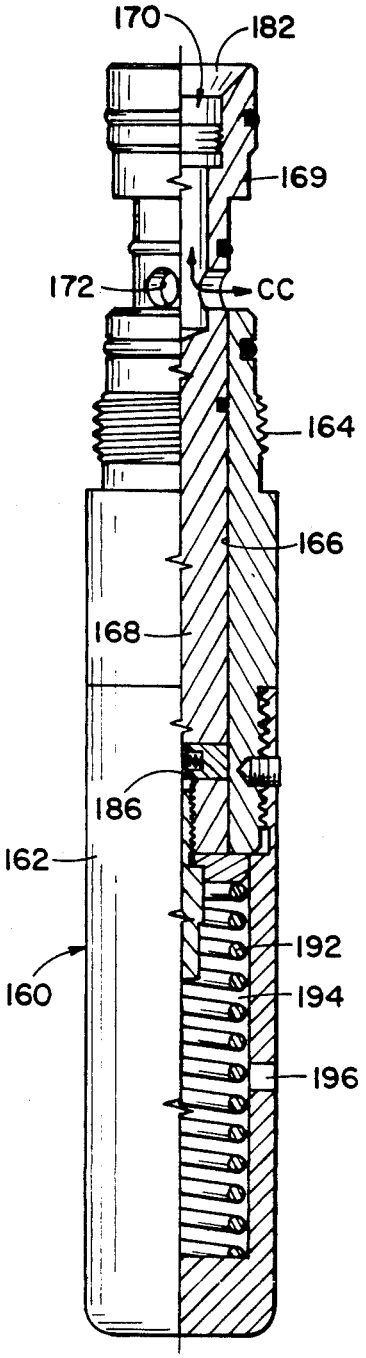
FIG. 5 shows an alternative embodiment of the automatic closure valve of the present invention.

FIG. 5 illustrates a simplified automatic closure valve which is similar to that shown in FIGS. 3 and 4 in that the valve 160 includes a valve body 162 having threads 164 and an inner bore 166. A rod and piston assembly 168 includes an upper portion 169 having a central bore 170 and reverse circulation passages 172 allowing reverse circulation in the direction of arrows CC. The operation of the automatic closure valve 160 is essentially the same as that previously described in that increased fluid pressure in the central bore 170 causes the rod and piston assembly 168 to move inwardly into the inner bore 166 of the valve outer body 162 until the locking pawl 186 snaps outwardly when the reverse circulation passages 172 are closed off. The difference in operation is that the dampening against premature closure of the valve is effected by a spring 192 located in a lower chamber 196 of the valve outer body 162. A pressure relief port 196 allows fluid within the lower chamber 194 to pass freely outwardly out of the valve body 162. As with the previously described automatic closure valve, a ball seat 182 is incorporated into the upper portion 169 of the rod and piston assembly 168 to effect sealing of the reverse circulation ports 172 as a back-up in the event of a failure of the automatic closure valve mechanism.

While the invention has been described in the more limited aspects of a preferred embodiment thereof, other embodiments have been suggested and still others will occur to those skilled in the art on a reading and understanding of the foregoing specification. It is intended that all such embodiments be included within the scope of this invention as limited only by the appended claims.

Having thus described my invention, I claim:

1. An apparatus for closing a reverse circulation passage and opening a crossover fluid passage in a gravel packing service tool which sets a well packer comprising:

(a) closure means for closing said reverse circulation passage including (i) a valve ring having a substantially cylindrical bore and a radially disposed upper surface; and (ii) a substantially cylindrical rod and piston assembly movable within said bore, said assembly including a partial axial fluid flow passage and a connecting radially disposed fluid port whereby fluid flowing within said fluid flow passage flows outwardly of said assembly through said port when said port is in an open position axially away from said radially disposed upper surface and resilient damper means comprising restricted fluid passage openings between an upper fluid chamber and a lower fluid chamber of said cylindrical bore restraining movement of said piston within said bore and maintaining said port in said open position under relatively low fluid pressure conditions, and (b) opening means for opening said crossover fluid passage comprising a sliding sleeve and a snap ring intermediate said sliding sleeve and a packer which engages a corresponding shoulder on said packer in response to an axial lifting force on said service tool whereby said sliding sleeve moves axially to open said crossover passage.

2. The apparatus as set forth in claim 1 further including a locking pawl for locking said closure means in a closed position.

3. An automatic closure valve comprising:

(a) a sleeve having a substantially cylindrical bore and radially disposed upper surface; and (b) a substantially cylindrical rod and piston assembly movable within said bore, said assembly including a partial axial fluid passage and a connecting radially disposed fluid port whereby fluid flowing within said fluid passage flows outwardly of said assembly through said port when said port is in an open position axially away from said radially disposed upper surface and resilient damper means comprising said piston including restrictive fluid flow openings between an upper fluid chamber and a lower fluid chamber of said cylindrical bore restraining movement of said piston within said bore and maintaining said port in said open position under relatively low fluid pressure conditions.

4. The automatic closure valve as set forth in claim 3 further including a locking pawl for locking said automatic closure valve in a closed position.

* * * * *